US005447108A

United States Patent [19]

Hamill et al.

[11] Patent Number: 5,447,108

[45] Date of Patent: Sep. 5, 1995

[54] SNAP ACTION THREAD AND GIMP TRIMMING ON A BUTTONHOLE MACHINE

[75] Inventors: Joseph M. Hamill, King William; Ronald A. Hulit; Anthony M. Lewandowski, II, both of Mechanicsville, all of Va.; Gerd Papajewski; Reinhold Papajewski, both of Karlsruher, Germany

[73] Assignee: AMF Reece, Inc., Mechanicsville, Va.

[21] Appl. No.: 128,122

[22] Filed: Sep. 29, 1993

[51] Int. Cl.[6] ..... D05B 3/08; D05B 65/00; B26D 1/08

[52] U.S. Cl. ..... 112/66; 112/253; 112/298; 83/586

[58] Field of Search ..... 112/65, 66, 67, 68, 112/291, 292, 296, 298, 299, 253; 83/586, 587, DIG. 950, DIG. 902, DIG. 905; 30/296.1

[56] References Cited

U.S. PATENT DOCUMENTS

| | | | |
|---|---|---|---|
| 807,239 | 12/1905 | Britton | 83/586 |
| 1,492,133 | 4/1924 | Kiewicz | 112/296 |
| 1,638,785 | 8/1927 | Ray | 112/296 |
| 1,743,356 | 6/1930 | Kiewicz | 112/291 |
| 1,846,398 | 2/1932 | Kiewicz | 112/291 X |
| 1,865,140 | 6/1932 | Reece | 112/291 |
| 1,988,460 | 1/1935 | Pikul | 112/291 X |
| 2,210,639 | 8/1940 | Spaine et al. | 112/291 |
| 3,254,616 | 6/1966 | Pudelko | 112/253 X |
| 3,365,991 | 1/1968 | Smith | 83/586 X |
| 3,688,716 | 9/1972 | Heimann et al. | 112/253 X |
| 3,894,459 | 7/1975 | Deppe et al. | 83/586 X |
| 4,404,921 | 9/1983 | Kastrup et al. | 112/291 |

FOREIGN PATENT DOCUMENTS

| | | | |
|---|---|---|---|
| 1485265 | 11/1969 | Germany | 112/291 |

*Primary Examiner*—Clifford D. Crowder
*Assistant Examiner*—Ismael Izaguirre
*Attorney, Agent, or Firm*—James Creighton Wray

[57] ABSTRACT

The invention relates to thread trimming devices for eyelet buttonhole machines. The invention comprises a thread trimming device having a snap action spring arm knife. As the thread hook positions the thread and gimp, a cam lifts up the end of the spring arm. The cam then releases the knife whose torque snaps down and cuts the thread and gimp against a second knife edge. The thread and gimp are also held together at this point for the next buttonhole by a thread retainer which is built into the knife.

15 Claims, 1 Drawing Sheet

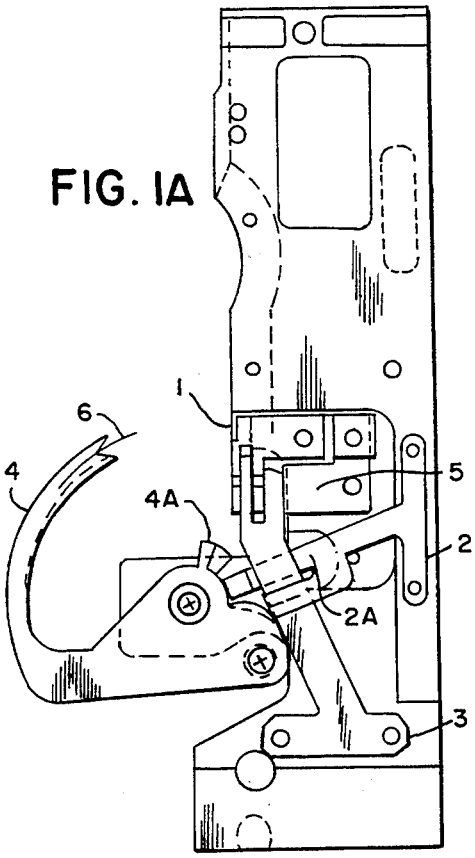
FIG. 1A
FIG. 1B
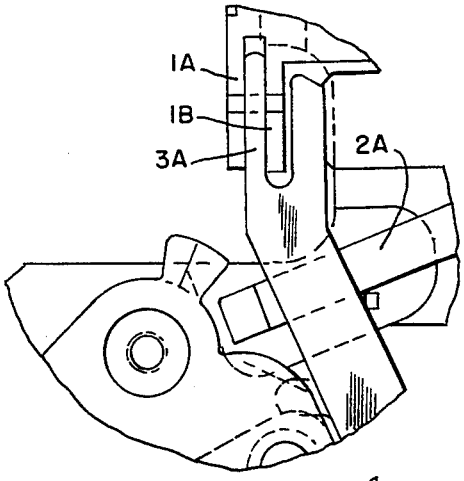
FIG. 3C
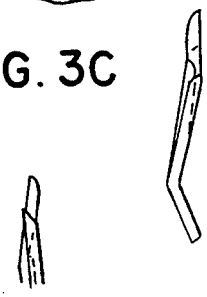
FIG. 3E
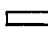
FIG. 2B
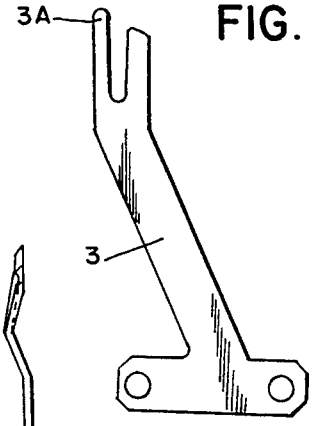
FIG. 3A
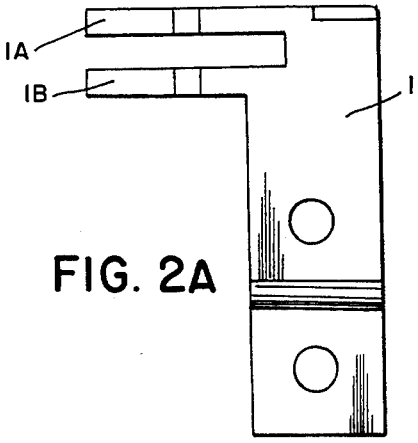
FIG. 2A
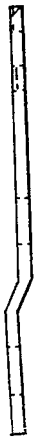
FIG. 2C
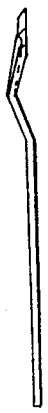
FIG. 3B
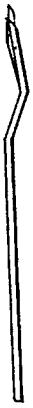
FIG. 3D

SNAP ACTION THREAD AND GIMP TRIMMING ON A BUTTONHOLE MACHINE

BACKGROUND OF THE INVENTION

FIELD OF THE INVENTION

The invention pertains to an eyelet buttonhole machine that trims thread and/or gimp after the buttonhole has been sewn. More specifically, it pertains to an eyelet buttonhole machine with long tail trimming (LTT) capability. The snap action cutting trims the thread after it has been set of a specific length and retains it's length for starting the next buttonhole.

Most eyelet buttonhole machines use a scissor-like trimming mechanism. The thread is guided by one knife edge until it reaches a second knife edge and is cut. The problems associated with scissor cutting is that they must be maintained and adjusted more often to achieve a reliable and consistent cut.

SUMMARY OF THE INVENTION

The object of this invention is to provide a trimming mechanism that offers consistent thread trimming and longer trimmer life.

Another object is to clamp the thread for the start of the next buttonhole at the same time as trimming it from the previous buttonhole. By retaining the thread and gimp together, equal tail lengths are achieved on each buttonhole.

After the buttonhole is sewn, the thread and gimp are positioned to be cut at a predefined length. As they are positioned, a cam surface lifts up a spring arm knife edge under which to position the thread. The torqued knife is then released and the thread is cut against a second knife edge. At the same time the thread is captured by a thread retainer.

BRIEF DESCRIPTION OF THE DRAWINGS

FIG. 1A shows the trimming mechanism of the present invention. FIG. 1B is an enlarged close-up view of the snap action trimming device.

FIGS. 2A, 2B and 2C show details and enlarged close-up views of the retainer.

FIGS. 3A–E show details and enlarged close-up views of the knives of the invention.

DETAILED DESCRIPTION OF THE DRAWINGS AND DESCRIPTION OF THE PREFERRED EMBODIMENT

After the buttonhole is sewn, FIG. 1A shows the trimming mechanism of the present invention. FIG. 1B is an enlarged close-up view of the snap action trimming device of the present invention the thread and gimp are positioned to be cut at a predefined length by the thread hook 4. As they are positioned, a cam surface 4A on the thread hook 4 lifts up the lever 2, which in turn lift the top knife edge 3 under which to position the thread. The torqued knife 3 is then released as the cam surface 4A ends and the thread is cut against a second knife edge 5. At the same time the thread is captured by the fingers 1A and 1B on retainer 1 and 3A on the top knife.

The thread hook 4 positions a predetermined length of the thread and gimp (both diagrammatically shown as 6) on the retainer 1. As the thread hook moves the cam surface 4A moves under the lever arm 2A to lift the lever 2. That movement causes the knife 3 to be lifted. By now, the cam surface 4A moves beyond the lever, thereby releasing the lever from a lifted position. The release of the lever 2 to come down to its original position makes the lifted knife 3 move back in a snap down action. That action, simultaneously, catches the thread between the fingers 1A and 1B of the retainer and the arm 3A of the knife 3 which positions between the fingers 1A and 1B, as well as cuts the thread by the torque exerted by the snapping down of the other arm of the knife on the blade 5.

I claim:

1. A snap action thread trimming mechanism, comprising:

a lever and a spring arm knife, for effecting a snap down action for trimming a bottom thread and a gimp simultaneously when the spring arm knife is lifted and released by the lever, a stationary knife for trimming the thread and cutting the gimp together with the spring arm knife.

2. The snap action mechanism as recited in claim 1, further comprising:

an extension on the spring arm knife for catching the thread and the gimp after trimming, and an extension on the stationary knife for retaining the thread and the gimp after trimming.

3. A thread trimming apparatus for buttonholing machines comprising:

a thread hook with a cam surface for positioning at a predetermined length a thread and a gimp to be cut;

a first knife for snapping down and catching the thread and the gimp;

a thread retainer for retaining the thread; and a second knife for simultaneously trimming the thread and the gimp together with the first knife.

4. The apparatus of claim 3, wherein the first knife is a stationary torqued knife.

5. The apparatus of claim 3, wherein the second knife is a movable spring arm knife.

6. The apparatus of claim 3, wherein the thread retainer further comprises:

a first extension for catching the thread and the gimp; and a second extension for retaining the thread and the gimp.

7. The apparatus of claim 6, wherein the first extension is on the first knife.

8. The apparatus of claim 6, wherein the second extension is on the second knife and comprises first and second fingers for retaining the thread.

9. A method of thread trimming for buttonholing machines comprising the steps of:

positioning at a predetermined length a thread and a gimp to be cut by a thread hook having a cam surface;

snapping down a first knife and catching the thread and the gimp;

retaining the thread by a thread retainer; and simultaneously trimming the thread and the gimp by a second knife together with the first knife.

10. The method of claim 9, wherein effecting the snap down action is done by providing the first knife as a stationary torqued knife.

11. The method of claim 9, wherein the trimming is done by providing the second knife as a movable spring arm knife.

12. The method of claim 9, wherein the retaining further comprises:

catching the thread and the gimp by a first extension; and retaining the thread and the gimp by a second extension.

13. The method of claim 12, wherein the catching comprises providing the first extension on the first knife.

14. The method of claim 12, wherein the retaining comprises providing the second extension on the second knife.

15. The method of claim 9, further wherein the trimming comprises:

simultaneously lifting and releasing the first knife;

catching the thread and the gimp;

moving the second knife to cut the caught thread and the gimp.

* * * * *